US006000380A

United States Patent [19]

Weisbarth

[11] Patent Number: 6,000,380

[45] Date of Patent: Dec. 14, 1999

[54] FUEL INJECTION FOR A MULTICYLINDER INTERNAL COMBUSTION ENGINE

[75] Inventor: Markus Weisbarth, Weil im Schöbuch, Germany

[73] Assignee: Daimler Chrysler AG, Stuggart, Germany

[21] Appl. No.: 09/138,911

[22] Filed: Aug. 24, 1998

[30] Foreign Application Priority Data

Aug. 30, 1998 [DE] Germany ..... 19737968

[51] Int. Cl.[6] ..... F02M 37/04

[52] U.S. Cl. ..... 123/456; 123/468

[58] Field of Search ..... 123/456, 468, 123/469, 470

[56] References Cited

U.S. PATENT DOCUMENTS

| | | | |
|---|---|---|---|
| 3,507,263 | 4/1970 | Long | 123/456 |
| 4,512,368 | 4/1985 | Kaminaka et al. | 137/561 A |
| 4,526,151 | 7/1985 | Tateishi et al. | 123/468 |
| 5,297,523 | 3/1994 | Hafner | 123/456 |
| 5,373,824 | 12/1994 | Peters et al. | 123/456 |
| 5,592,968 | 1/1997 | Nakashima et al. | 123/456 |
| 5,752,486 | 5/1998 | Nakashima et al. | 123/467 |
| 5,852,997 | 12/1998 | Vanderpost | 123/456 |

FOREIGN PATENT DOCUMENTS

| | | |
|---|---|---|
| 32 30 843 | 2/1984 | Germany . |
| 43 35 171 | 5/1995 | Germany . |
| WO 84/00792 | 3/1984 | WIPO . |

*Primary Examiner*—Thomas N. Moulis
*Attorney, Agent, or Firm*—Klaus J. Bach

[57] ABSTRACT

In a fuel injection system for a multicylinder internal combustion engine, particularly a V8 engine, including a high pressure fuel pump supplying high pressure fuel to a high pressure fuel supply duct serving as a high pressure fuel storage (common rail) from which high pressure fuel distribution lines extend to magnetic valve-controlled fuel injectors associated with the various cylinders of the engine, the distribution lines have an inner diameter of at least 2.99 mm and a length of less than 122 mm with an inner diameter to length ratio of between 1:36 and about 1:41 to reduce pressure oscillations in the fuel system.

2 Claims, 1 Drawing Sheet

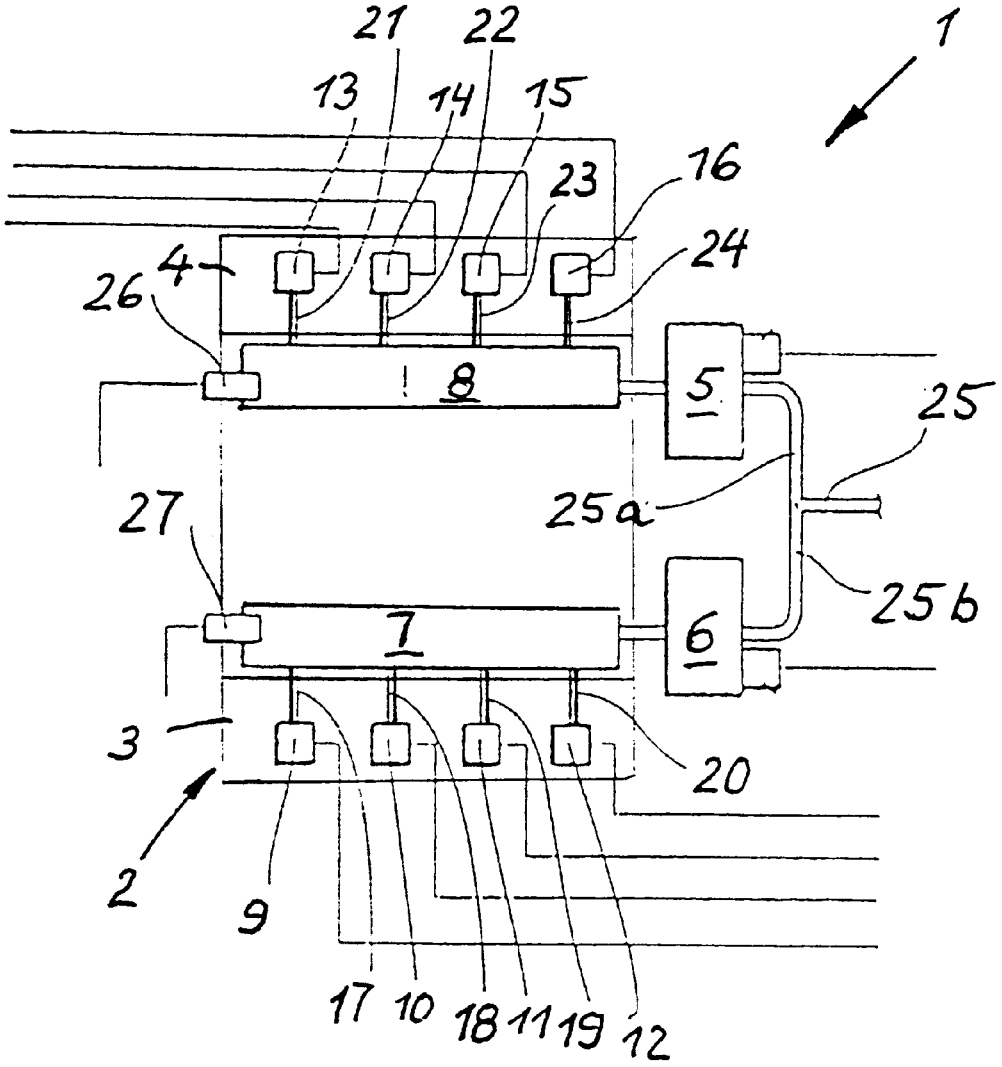
1
21
22
13
14
15
16
23
24
4
26
8
5
25
25a
27
25b
7
6
3
20
2
9
17
10
18
11
19
12

FUEL INJECTION FOR A MULTICYLINDER INTERNAL COMBUSTION ENGINE

BACKGROUND OF THE INVENTION

The invention relates to a fuel injection system for a multicylinder internal combustion engine, particularly an eight cylinder engine, including a high pressure pump for supplying the fuel to a common supply line serving as a pressurized fuel storage structure (common rail) from which fuel injection lines extend to magnetic valve controlled fuel injectors.

Such a fuel injection system for multicylinder internal combustion engines is known form DE 43 35 171 C1, wherein a common supply line is provided for the cylinders of each cylinder bank of the internal combustion engine. The embodiments shown in FIGS. 2 and 4 of the reference relate to eight cylinder engines including two cylinder banks with a firing order by which subsequent ignitions occur at least once in one of the two cylinder banks.

With the particular injection procedures, undesirably high pressure oscillations occur in all injection lines particularly in eight cylinder internal combustion engines. These pressure oscillations are not attenuated during the short ignition interval of 90°. As a result, the injection volume varies excessively with negative effects particularly in injection systems employing pre-injection with a subsequent injection of the main fuel injection volume.

It is the object of the present invention to provide an injection system with a high pressure fuel storage structure wherein, with simple measures, pressure oscillations in any of the fuel distribution lines extending from the high pressure fuel storage structure to the various fuel injectors do not detrimentally affect the injection process through other fuel distribution lines.

SUMMARY OF THE INVENTION

In a fuel injection system for a multicylinder internal combustion engine, particularly a V8 engine, including a high pressure fuel pump supplying high pressure fuel to a high pressure fuel supply duct serving as a high pressure fuel storage (common rail) from which high pressure fuel distribution lines extend to magnetic valve-controlled fuel injectors associated with the various cylinders of the engine, the distribution lines have an inner diameter of at least 2.99 mm and a length of less than 122 mm with an inner diameter to length ratio of between 1:36 and about 1:41 to reduce pressure oscillations in the fuel system.

It has been found by extensive tests that the detrimental pressure oscillations in pressurized fuel distribution lines having the given diameter/length ratio are substantially reduced. As a result, the fuel injection volume variations are reduced, that is, the fuel injection volume distribution for the various cylinders is quite uniform.

With the arrangement according to the invention, the fuel pressure oscillation occurring particularly in internal combustion engines with short firing or injection time gaps can be minimized in a simple manner. This provides for a more uniform fuel injection volume for the various cylinders resulting in a reduction of engine emissions, in smoother engine operation and in lower engine noise.

DE 32 30 843 A1 discloses a fuel injection system with a predetermined arrangement of the fuel injection lines having flow cross-sections which becomes smaller from the fuel entrance end toward the fuel exit end. This measure is said to reduce the load on the fuel injection pump caused by the high peak pressures. This injection system is actually a pump line-nozzle injection system wherein—in contrast to a common rail system including a high pressure storage structure, by way of which the fuel supply lines are in communication with each other—the lines from the injection pump to the various injectors are physically separated so that oscillations cannot be transmitted from one of the high pressure fuel supply lines to another.

The invention will be described below on the basis of the accompanying drawing.

BRIEF DESCRIPTION OF THE DRAWINGS

The sole FIGURE shows schematically a V8 engine with a fuel injection system according to the invention.

DESCRIPTION OF A PREFERRED EMBODIMENT

As shown in the figure, a fuel injection system 1 with a high pressure fuel storage for a V-type eight cylinder Diesel engine 2 with two cylinder banks 3 and 4 includes two high pressure fuel pumps 5 and 6, two fuel supply ducts 7 and 8 serving as high pressure fuel storage devices and injection valves 9 to 16 in communication with the respective fuel supply ducts 7 and 8 by fuel injection lines 17 to 24. The supply ducts 7 and 8 are disposed in the V-space formed between the two cylinder banks 3 and 4.

From the supply duct 7 for the cylinder bank 3, injection lines 17, 18, 19 and 20 extend to the injection valves 9, 10, 11 and 12 and from the supply duct 8 for the cylinder bank 4 injection lines 21, 22, 23 and 24 extend to the injection valves 13, 14, 15 and 16.

Each of the injection lines has a predetermined length between the respective supply duct and the respective injection valve and also a predetermined inner diameter. The ratio of the inner diameter to the length of each injection line is approximately 1:41, wherein the inner diameter of the injection line is 3.0 mm and the length of the injection line is accordingly 122 mm.

It has been found that these dimensions provide an optimum for an eight cylinder internal combustion engine with a firing order of 1-5-4-2-6-3-7-8, whereby pressure oscillations in the pressurized fuel supply system and consequently fuel injection volume deviations are minimized.

The figure also shows a common fuel supply line 25 with branches 25*a*, 25*b* leading to the high pressure pumps 5 and 6 and also pressure sensors 26 and 27 arranged at the ends of the high pressure fuel supply ducts 8 and 7.

What is claimed is:

1. A fuel injection system for a multicylinder internal combustion engine with fuel injection, particularly a V8 engine, including: a high pressure fuel pump, at least one high pressure fuel supply duct (common rail) providing for a high pressure fuel storage in communication with said high pressure fuel pump to receive fuel under pressure therefrom, and high pressure fuel distribution lines extending from said high pressure fuel supply duct to magnetic valve-controlled fuel injectors mounted on said cylinders for the controlled injection of fuel, said high pressure fuel distribution lines having an inner diameter-to-length ratio of between 1:36 and about 1:41 with an inner diameter of said distribution line >2.99 mm and a length of said distribution lines <122 mm.

2. A fuel injection system according to claim 1, wherein the ratio of the inner diameter to the length of said fuel distribution lines is about 1:41.

* * * * *